US005484088A

United States Patent [19]

Martin

[11] Patent Number: 5,484,088

[45] Date of Patent: Jan. 16, 1996

[54] PRESETTABLE INDEXED ADJUSTABLE DOSE DISPENSER

[76] Inventor: James H. Martin, 8322 County Line Rd., Burr Ridge, Ill. 60521

[21] Appl. No.: 235,083

[22] Filed: Apr. 29, 1994

[51] Int. Cl.[6] ..... B65D 83/16

[52] U.S. Cl. ..... 222/402.2

[58] Field of Search ..... 222/402.1, 402.11, 222/402.2, 402.17

[56] References Cited

U.S. PATENT DOCUMENTS

| | | | |
|---|---|---|---|
| 2,932,432 | 4/1960 | Beard, Jr. | 222/402.2 |
| 3,018,928 | 1/1962 | Meshberg | 222/402.2 |
| 3,052,382 | 9/1962 | Gawthrop | 222/402.2 |
| 3,055,560 | 9/1962 | Meshberg | 222/402.2 |
| 3,104,785 | 9/1963 | Beard, Jr. | 222/402.2 |
| 3,180,535 | 4/1965 | Ward | 222/402.2 |
| 3,180,536 | 4/1965 | Mesberg | 222/402.2 X |
| 3,187,962 | 6/1965 | Meshberg | 222/402.2 |
| 3,511,418 | 5/1970 | Venus, Jr. | 222/402.2 |
| 3,531,026 | 9/1970 | Venus, Jr. | 222/402.11 |
| 3,601,290 | 8/1971 | Nigro | 222/402.11 |
| 3,721,423 | 3/1973 | Shay | 222/402.11 X |
| 4,819,834 | 4/1989 | Thiel | 222/402.2 |
| 4,858,790 | 8/1989 | Howlett | 222/402.2 |
| 5,037,013 | 8/1991 | Howlett | 222/402.2 |
| 5,085,351 | 2/1992 | Martin | 222/402.2 |
| 5,183,187 | 2/1993 | Martin | 222/402.2 |

*Primary Examiner*—Andres Kashnikow
*Assistant Examiner*—Kenneth Bomberg
*Attorney, Agent, or Firm*—Patnaude, Videbeck & Marsh

[57] ABSTRACT

An adjustable liquid dose dispenser utilizes complimentary, interfitting parts on a rotationally adjustable actuator on the cover of a pressurized container to index a rotationally adjustable valve stem relative to a plurality of reference marks on the actuator.

10 Claims, 4 Drawing Sheets

PRESETTABLE INDEXED ADJUSTABLE DOSE DISPENSER

The present invention relates in general to a pressurized unit dispenser of the type described in my earlier U.S. Pat. Nos. 5,085,351, and 5,183,187 and it relates more particularly to a new and improved dispenser in which a plurality of unit doses can be indexed and preset for subsequent administration.

BACKGROUND OF THE INVENTION

The dispenser which is described in the above referenced U.S. Pat. No. 5,085,351 is particularly useful in the administration of insulin by spraying a selected dose of insulin into the nasal passages of the patient upon each actuation of the dispenser. Adjustment of the dose is carried out by rotating a rotatable metering valve member, and indicia are provided on the collar to indicate the dosage dispensed at each of several annular positions of the metering valve member.

In order to assure that only the proper dose of the medication is dispensed, i.e., to prevent inadvertent rotation of the adjustment mechanism, it would be desirable to incorporate means in the dispenser to lock the adjustment mechanism in the adjusted position to prevent spurious rotation thereof. It would also be desirable to modify the dispenser mechanism described in my said patents to facilitate manufacture thereof, and particularly to facilitate the initial setting of the dispensing mechanism relative to the adjusting mechanism thereby improving the quality of the dispenser while reducing the manufacturing cost thereof. In certain instances it may be desirable to convert the adjustable dose dispenser into a unit dose dispenser.

SUMMARY OF THE INVENTION

Briefly, there is provided in accordance with the present invention an improved adjustable dose dispenser of the type for which the valve of the dispenser can be rotated to adjust the amount of the dose given. The dispenser incorporates a ferrule to which the dispensing mechanism is mounted and which is sealably clamped over the open end of the associated sealable container holding the insulin or other fluid to be dispensed. Mounted over the ferrule is a collar carrying an indexing structure which is adapted to mate with an actuator and actuator nozzle to limit the angular positions of the actuator at which it can be depressed to actuate the dispenser. A locator pin or the like is integral with the non-rotatable portions of the valve and it extends outwardly through aligned openings in the ferrule and in the collar to provide positive alignment of the non-rotatable portion of the valve with the collar.

The actuator has an index reference which may be aligned with dosage indicators provided on the circumferential surface of the collar. The actuator is further provided with means for operating the metering valve at one angular position only to fixedly align the actuator with the metering valve. The actuator may also contain a locking mechanism which converts the adjustable dose dispenser into a unit dose dispenser.

BRIEF DESCRIPTION OF THE DRAWING

Further objects and advantages of the present invention will be apparent to those skilled in the art from a reading of the following detailed description of the invention taken in connection with the drawings wherein.

DETAILED DESCRIPTION OF THE PREFERRED EMBODIMENT

Figure 1:
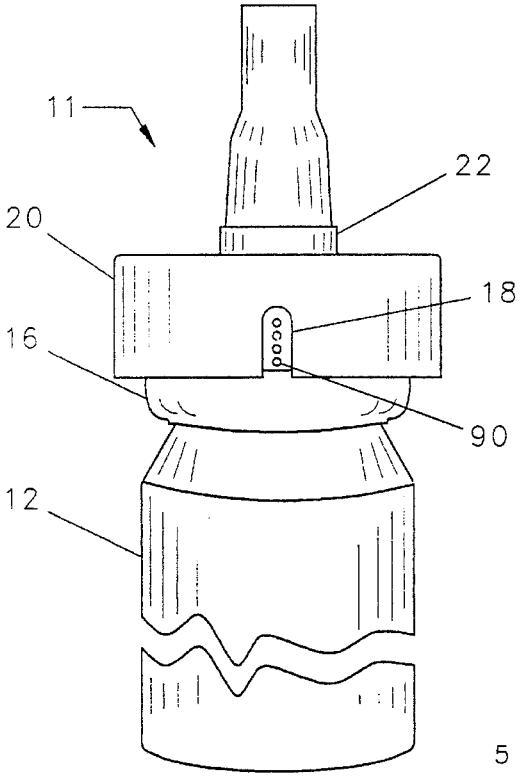
FIG. 1 is a front elevational view of a dispenser embodying the present invention.
Figure 2:
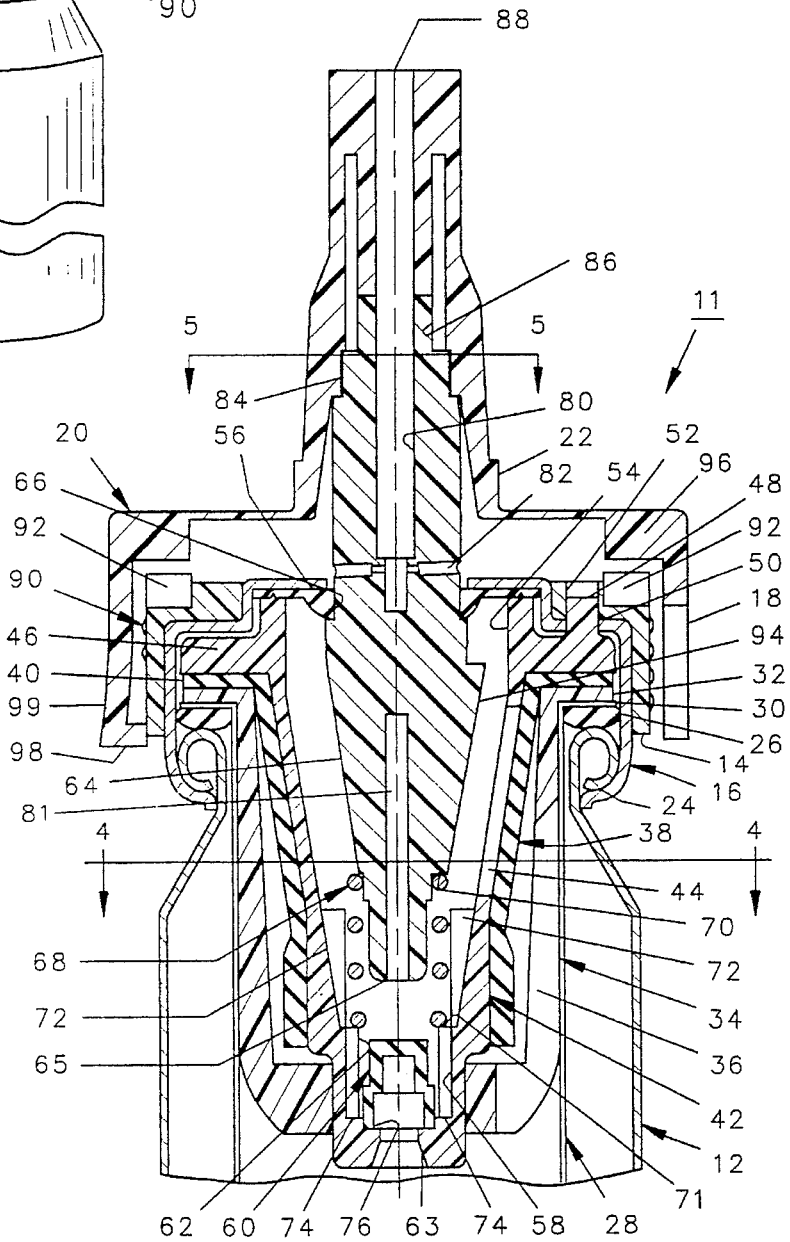
FIG. 2 is a vertical cross-sectional view of the device shown in FIG. 1 with the dispensing mechanism in the fill position.

Referring to FIG. 1, there is shown a presettable adjustable dose dispenser 11 including a sealed canister 12 containing a fluid to be dispensed in a pressurized state. The fluid may be liquid insulin and/or some other fluid. As shown in FIG. 2, a collar member 14 partially overlies a ferrule 16 which, as described in greater detail hereinafter, mounts the dispenser mechanism located within the canister to the canister. The collar 14 is provided on its side with a plurality of dosage indicators, only one 90 of which is visible in FIG. 1, with which a reference window 18 in the side wall of an actuator 20 and actuator nozzle 22 is adapted to be aligned. The device is actuated by depressing the actuator 20 which in turn actuates the dispensing mechanism within the canister 12 to spray a dose through the actuator nozzle 22. The dose amount emitted corresponds to that indicated by the dosage indicator 90 which can be seen through the window 18 in the actuator 20. The actuator 20 can only be moved into the actuating position when it is in one of a plurality of discreet positions where one of the dosage indicators on the side wall of the collar 14 is aligned with the reference window 18 in the side of the actuator 20. While the actuator nozzle 22 shown in the drawing is for use in spraying insulin into the nostrils of a patient, it will be understood by those skilled in the art that other dispensing heads can be provided for dispensing other fluids where desired.

Figure 9:
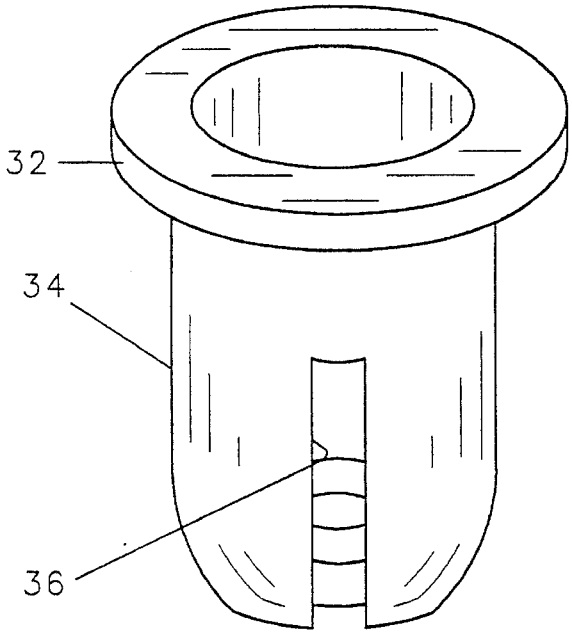
FIG. 9 is an isometric view of the protector member in the valve as shown in FIGS. 2 and 3.

Referring further to FIG. 2, it will be seen that a plurality of separate parts or elements which make up the dispensing mechanism are assembled in mutually stacked relationship in the upper portion of the canister 12. As may be seen, the top of the canister 12 is rolled outwardly at 24 and a resilient elastomeric O-ring 26 is disposed on the top thereof. A flexible barrier bag 28 has an external annular flange 30 which extends across the upper surface of the O-ring 26 and an external annular flange 32 on a rigid plastic protector member 34 rests on the top of the flange 30. The member 34 is cup-shaped and has a plurality of vertical slots 36 (best shown in FIG. 9) which open onto the inside of the barrier bag 28. An elastomeric, tubular cone-shaped member 38 has an annular flange 40 at the top thereof which rests on the top of the flange 32 on the protector member. A tubular rigid body member 42 having a window 44 in the wall thereof has an external annular flange 46 at the top thereof which rests on the top of the elastomeric member 38 just below the upper end portion of the ferrule 16 and a plurality of detents extend radially inwardly from the ferrule 16 under the bottom edge surface of the flange 46 to fixedly position the body member 42 relative to the ferrule.

An upstanding locator pin 48 is an integral part of the body member 42 and extends upwardly through a hole 50 in the ferrule into an axially aligned locator hole 52 in the collar 14 thereby orienting the window 44 with the collar 14. Internally of the pin 48, the body member 42 is provided with an upstanding cylindrical tubular portion 54 which is pressed against an elastomeric sealing washer 56 which is sealably compressed at its outer edge portion between the tubular portion 54 and the ferrule 16. It will thus be seen that the locator pin 48 is sealed from the interior of the body member 42 and from the space within the canister 12 external of the bag 28.

The lower end portion of the body member 42 is fitted tightly into a cylindrical bore 58 at the bottom of the body protector member 34 to maintain the lower of the parts in mutual axial alignment. An imperforate elastomeric tassie 60 loosely fits in a cylindrical bore 62 at the lower end of the member 42 and is prevented from dropping through the bottom of the assembly by an internal annular flange 63 on the body member 42. The tassie 60 is mounted in an inverted position and its upper end is adapted to be abutted by the lower end 65 of a metering valve member 64 which is positioned along the central vertical axis of the dispensing mechanism and extends through the sealing washer 56 which sealably fits into an annular recess 66 in the valve member 64.

A coil spring 68 is compressed between a downwardly facing shoulder 70 on the valve member 64 and an upwardly facing internal annular shoulder 71 on the body member 42. A plurality of angularly spaced ribs 72 provide guide surfaces which maintain the spring 68 in axial alignment. A plurality of elongate slots 74 in the inner wall of the body member 42 provide communication with the space between the valve member 64 and the body member 42 with the cavity within the bag 28 when the tassie is pressed upwardly away from the internal annular shoulder 76. This tassie is pressed upwardly by the pressurized fluid in the bag 28 during the fill cycle of the dispenser as more fully described hereinafter.

A blind, axial bore 80 extends from the upper distal end of the valve member 64 and a plurality of radial passageways 82 extend from the bore 80 to the exterior of the valve member at a location a short distance above the sealing washer 56. The blind axial hole 81 in the lower end portion of the valve member 64 has no function in the dispensing mechanism and is provided only to facilitate manufacture of the dispenser.

Figure 5:
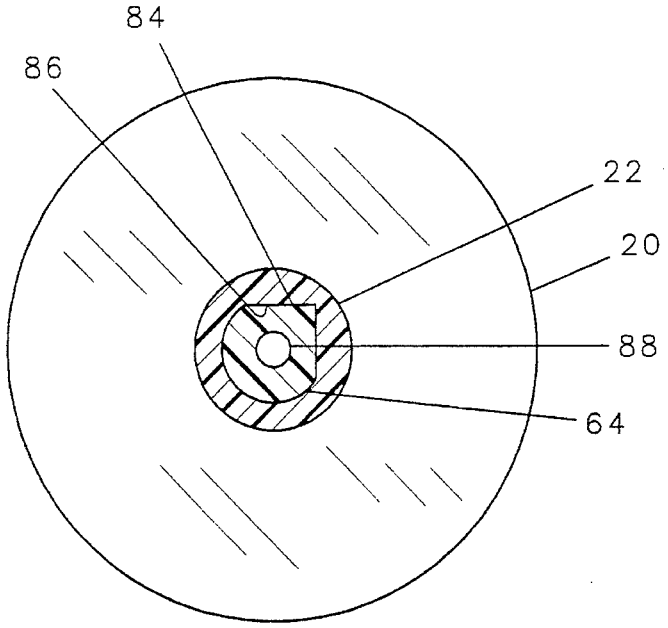
FIG. 5 is a horizontal cross-section taken along the line 5—5 of FIG. 2.

A non-circular section 84 of the valve member 64 mates with and is press fitted to a complimentary shaped interior section 86 of the actuator 20 and actuates nozzle 22, as best shown in FIG. 5, to hold the valve member 64 and the actuator 20 in assembled relationship so that the two parts move in unison for movement both rotationally and axially. As shown, the bore 80 in the valve member 64 is aligned with the nozzle orifice 88.

With the dispenser mechanism in the fill condition as illustrated in FIG. 2, the spring 68 is extended and biases the valve member to its uppermost position. While the tassie 60 is free to move between the shoulder 76 on the body member 42 and the bottom end 65 of the valve member 64, when the fluid within the bag 28 is under pressure, the tassie will be pressed upwardly against the bottom end 65 the valve member 64 to permit the space within the body member 42 to be filled with the fluid to be dispensed which enters the space between the bottom end 65 of the valve member 64 and the body member 42 through the passageways formed by the elongated slots 74. At this time, the system is in equilibrium with the pressure within the body member 42 being the same as the pressure within the bag 28. In order to pressurize the contents of the bag 28, the canister 12 may be filled with a pressurized gas or a resilient sleeve as described in my above referred patent.

Figure 3:
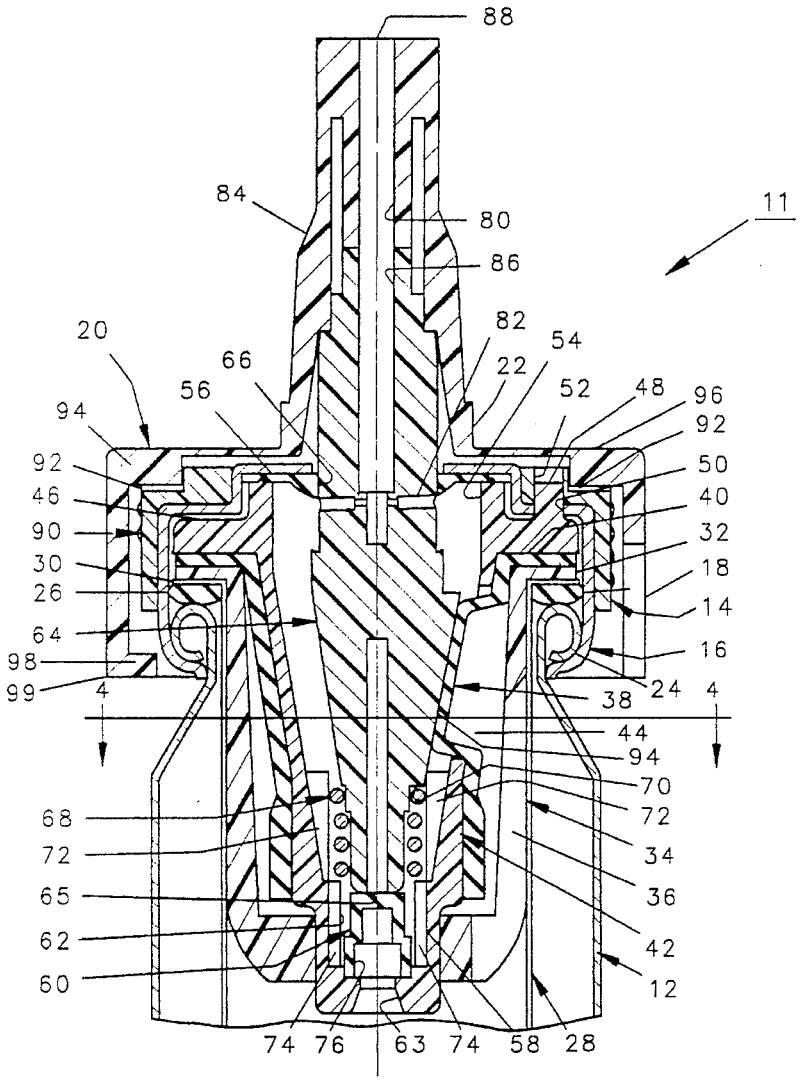
FIG. 3 is a vertical cross-sectional view of the device shown in FIG. 1 with the dispensing mechanism in the actuated spray position.
Figure 4:
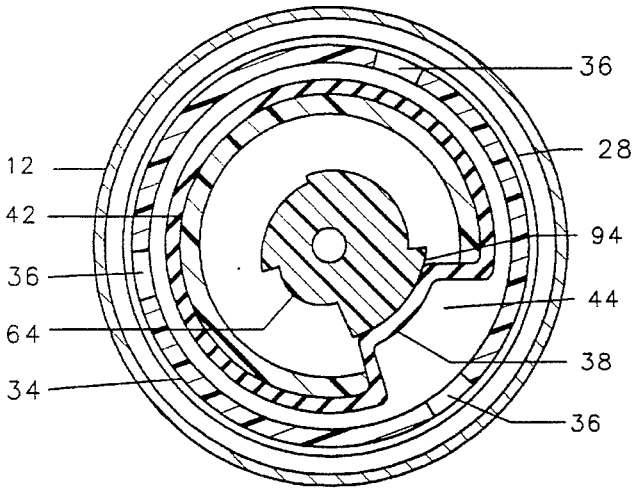
FIG. 4 is a horizontal cross-section taken along the line 4—4 of FIG. 2.

Refer now to FIG. 3 wherein the dispenser is shown in the actuated position wherein fluid is sprayed through the nozzle orifice 88 when the actuator 20 is first moved into the downward spray position. In order to administer a dose of the fluid through the actuator nozzle 22, the actuator is depressed by the user to compress the spring 68 and to press the tassie 60 tightly against the shoulder 76 thereby to seal off the interior of the member 42 from the fluid in the bag 28. When the radial holes 82 in the valve member are then moved below the washer 56, the space within the member 42 is communicated through the holes 82 to the axial passageway 80 in the valve member and thus to the nozzle orifice 88. The elastomeric member 38 is then pressed by the pressure on its exterior surface through the window 44 into contact with the opposite facial surface 94 of the valve member 64 to force a predetermined dose of the fluid through the radial holes 82 and the bore 80 to the spray orifice 88. Inasmuch as the intermediate external surface 94 of the valve member 64 is eccentric as best shown in FIG. 4, the angular position of the valve member 64 is determinative of the quantity of fluid which is dispensed each time the actuator is actuated. When the actuator 20 is subsequently released, the spring 68 expands and forcibly returns the dispensing mechanism to the fill position shown in FIG. 2.

In order to adjustably set the dose to be administered upon each actuation of the dispenser, it is necessary to rotate the actuator 20 and thus the valve member 64 which is attached thereto to the desired angular position relative to the window 44. This mechanism is essentially the same as that described in my earlier U.S. Pat. No. 5,085,351 referred to herein above.

Adjustment of the dosage given is facilitated by a plurality of dosage indicator embossments 90 provided on the external side of the vertical wall of the collar 14 and the window 18 of actuator 20. Each indicator includes a number of embossments which correspond to a distinct dose. To prevent actuation of the dispenser should the actuator 20 be spuriously rotated, a cooperative means consisting of a plurality of radial slots 92 are provided in the top surface of the collar 14, one respectively adjacent to each of the dosage indicators 90, and an equal plurality of elongate ribs 96 are provided in corresponding locations on the bottom of the actuator 20. The valve member 64 can only be depressed into the dispensing position when the ribs 96 are lined up with the slots 92. Consequently, if the actuator 20 and the collar 14 are not aligned to one of the dosage indicators 90, the ribs 96 will abut the top of the collar 14 and prevent movement of the valve member 64 into the dispensing position as shown in FIG. 3.

It will be appreciated that the features of the present invention can also be incorporated into a dispenser of the type disclosed in my U.S. Pat. No. 5,183,187 which has a movable piston. Rotation of the valve stem of the valve disclosed in my U.S. Pat. No. 5,183,187 will adjust the length of stroke of the piston and thereby adjust the dosage. Although the valve of my U.S. Pat. No. 5,183,187 operates on a different principal than the valve of my U.S. Pat. No. 5,085,351, the valve stem is the actuator and it can be configured as a cap similar to the cap 20 described above. The valve of U.S. Pat. No. 5,183,187 is actuated by compressing the valve stem inward, as is the dispenser described above. This valve may also be fitted with a locator pin 48 to correlate the volume dispensed by the valve to an indicator means similar to the indicator 90 and may have ribs and slots similar to the ribs 96 and slots 92 described above.

Figure 6:
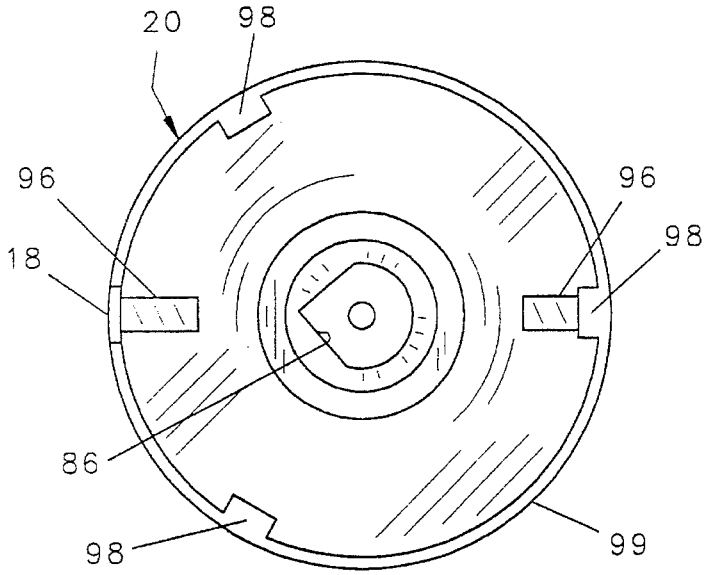
FIG. 6 is a view of the actuator taken from the bottom thereof.
Figure 7:
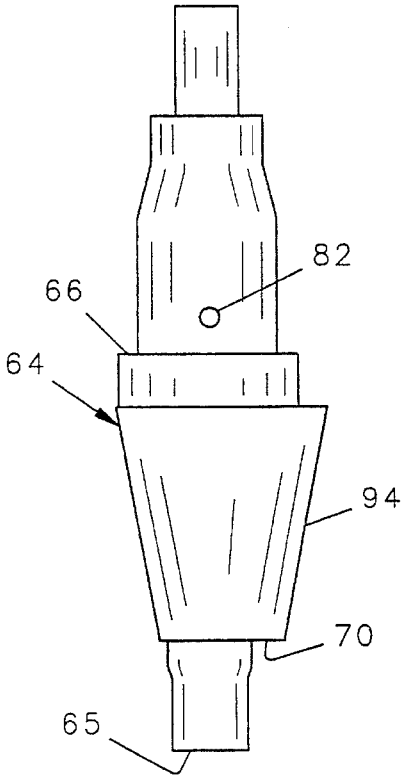
FIG. 7 is an elevational view of the metering valve member.
Figure 8:
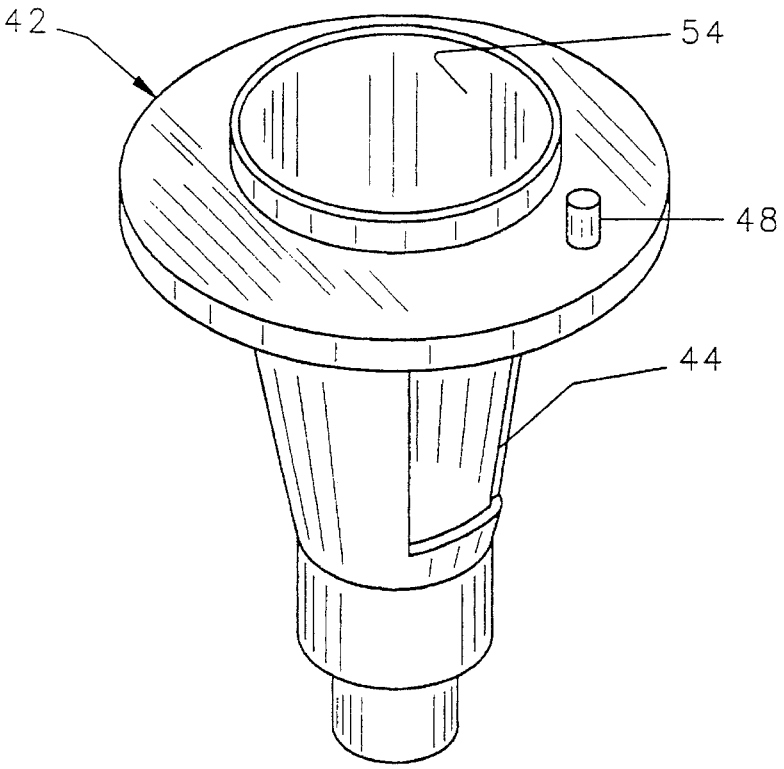
FIG. 8 is an elevational view of the member containing the window.

Referring to FIGS. 2, 3 and 6, the actuator 20 may also be provided with a plurality of inwardly extending tabs 98 spaced around the inner surface of the cylindrical lower skirt 99 of the actuator 20. The tabs 98 are positioned near the lower rim of the skirt 99, and when sold to the consumer, are positioned to be compressed against the outer surface of the collar 14, as best shown in FIG. 2. When the actuator 20 is depressed inward for the first use, the tabs 98 will be moved below the lower edge of the collar 14 and will snap inwardly to the position shown in FIG. 3, and thereafter will prevent the actuator 20 from returning to the fully elevated position shown in FIG. 2. The skirt 99 of the actuator 20 is long enough to permit vertical movement of the actuator 20 between the fill and actuated conditions as described above, but prevent vertical movement of the ribs 96 out of the slots 92. Consequently, a dispenser 11 having tabs 98 can be adjusted by rotating the actuator 20 to the desired dosage prior to the first actuation. After the first dose of fluid is dispersed, the tabs 98 will retain the actuator 20 in a partially compressed position with the ribs 96 and slots 92 partially interlocking, thereby providing a retention means for permanently retaining the dosage setting of the dispenser. A user can, therefore, set the dispenser 11 to dispense the dosage required, and after the first actuation, the dispenser will only dispense the selected dosage.

It should be appreciated that although the tabs 98, the locator pin 48 and locator hole 52 are all depicted in an adjustable dose dispenser of the type described in my U.S. Pat. No. 5,183,187 which incorporates an eccentric valve member 64, these features could be incorporated in any dose dispenser which is adjusted by rotating the actuator, and actuated by compressing the stem inward.

While one preferred embodiment of the present invention has been disclosed, it will be apparent to those skilled in the art that many changes and modifications may be made without departing from the true spirit and scope of the invention. It is, therefore, the purpose of the appended claims to cover all such changes and modifications that fall within the true spirit and scope of the invention.

What is claimed:

1. Dispensing apparatus for dispensing a predetermined quantity of a pressurized fluid, comprising in combination:

a receptacle enclosing a fluid supply chamber for containing a fluid, a valve assembly extending into said receptacle from an end of said receptacle, said valve assembly including a body member, and an elongate valve stem mounted for axial reciprocation in said body member, between a first dispensing position and a second fill position, an axial passageway in said stem, means responsive to the relative angular positions of said valve stem relative to said body member for adjusting the volume of a metering chamber for metering the volume of fluid dispensed, means for angularly orienting said body member relative to the angular position of said valve stem, actuator means mounted to said valve stem externally of said receptacle for axial and rotational movement therewith, means for locking said body member to said receptacle, and indexing means provided on said actuator means and on said receptacle for indexing the angular position of said valve stem relative to said body member and for indexing the size of said metering chamber.

2. Dispensing apparatus according to claim 1 wherein said means for orienting comprises a locator pin on one of said body member and said receptacle, the other of said body member and said receptacle having a locator hole therein for receiving said locator pin, and means for sealing said hole from said metering chamber and from said fluid supply chamber within said container.

3. Dispensing apparatus according to claim 2 wherein said receptacle includes a hollow container and a ferrule sealably attached over an opening therein, and a collar fitted over said ferrule, and said collar having one of said locator pin and said locator hole.

4. Dispensing apparatus according to claim 1 further comprising cooperative means on said actuator means and on said receptacle for preventing movement of said valve stem from said second fill position to said first dispensing position unless said actuator means and said receptacle are in one of a plurality of predetermined relative angular positions.

5. Dispensing apparatus according to claim 4 wherein said cooperative means comprises a plurality of recesses on one of said actuator means and said receptacle, and a plurality of protuberances on the other of said actuator means and said receptacle positioned to be received in said recesses only when said actuator means and said receptacle are in one of said predetermined relative angular positions.

6. Dispensing apparatus according to claim 4 further comprising:

retention means for permanently retaining said actuator means and said receptacle in one of said plurality of predetermined angular positions relative to each other after a first use of said dispensing apparatus.

7. Dispensing apparatus according to claim 6 wherein said retention means comprises:

means for retaining said valve stem and said actuator partially compressed relative to said receptacle.

8. Dispensing apparatus for dispensing a predetermined quantity of a pressurized fluid, comprising in combination:

a receptacle enclosing a fluid supply chamber for containing a fluid under pressure, a valve assembly extending into said receptacle from an end of said receptacle, said valve assembly including a body member, and an elongate valve stem mounted for reciprocation in said body member, an axial passageway in said stem extending from said first end to a position intermediate the ends thereof, and having an outlet to the side of said stem at a location spaced from said first end, said body member and said valve stem defining a metering chamber therebetween, said valve stem extending from said receptacle and being axially movable relative to said body portion between a first dispensing position and a second fill position, said outlet being in communication with said metering chamber when said valve stem is in said first dispensing position and being sealed from said metering chamber when said valve stem is in said second fill position, means responsive to the relative angular positions of said body member and said valve stem for adjusting the volume of said metering chamber, means for communicating said metering chamber with said fluid supply chamber when said valve stem is in said second fill position, means for angularly orienting said body member relative to the angular position of said valve stem, actuator means mounted to said valve stem externally of said receptacle for axial and rotational movement therewith, means for locking said body member to said receptacle, and viewable indexing means provided on said actuator means and on said receptacle for displaying the angular position of said-valve stem relative to said body member and for thus displaying the size of said metering chamber.

9. Dispensing apparatus for dispensing a predetermined quantity of a pressurized fluid, comprising in combination:

a receptacle enclosing a fluid supply chamber for containing a fluid, a valve assembly extending into said receptacle from an end of said receptacle, said valve assembly including a body member, and an elongate valve stem mounted for axial reciprocation in said body member, between a first dispensing position and a second fill position, an axial passageway in said stem, means responsive to the relative angular positions of said valve stem relative to said body member for adjusting the volume of a metering chamber for metering the volume of fluid dispensed, actuator means mounted to said valve stem externally of said receptacle for axial and rotational movement with said valve stem, indexing means on said actuator means and said receptacle for indexing the volume of fluid dispensed, means for retaining said valve stem in a fixed angular alignment with said actuator means, means for aligning the angular position of said body member relative to the angular position of said actuator means and said indexing means for synchronizing said indexing means with the volume of fluid dispensed by said dispensing apparatus.

10. A dispensing apparatus according to claim 9 and further comprising:

retention means for permanently retaining said actuator means and said receptacle in a chosen predetermined angular position relative to each other after a first use of said dispensing apparatus.

* * * * *